United States Patent [19]

Odermann

[11] 4,335,668

[45] Jun. 22, 1982

[54] PATTERN CONTROLLED SEWING MACHINE FOR PRODUCING TAILOR TACKS

[75] Inventor: Charles R. Odermann, Montville, N.J.

[73] Assignee: The Singer Company, Stamford, Conn.

[21] Appl. No.: 290,893

[22] Filed: Aug. 7, 1981

[51] Int. Cl.[3] ..... D05B 3/02

[52] U.S. Cl. ..... 112/158 E

[58] Field of Search ..... 112/158 E, 158 R, 221, 112/262.1

[56] References Cited

U.S. PATENT DOCUMENTS 3,847,100 11/1974 Garron ..... 112/158 E

OTHER PUBLICATIONS

Singer 2010 Instruction Book, p. 70.
Janome 5001 Instruction Book, p. 33.

*Primary Examiner*—Peter P. Nerbun
*Attorney, Agent, or Firm*—Robert E. Smith; Edward L. Bell

[57] ABSTRACT

A tailor tack producing arrangement for a sewing machine is disclosed in which stitch patterning data stored in an electronic memory produces a recurring pattern of two closely spaced thread concatenations followed by a multiplicity of work feed increments during which the sewing machine needle bar reciprocation is interrupted. A warning means is disclosed for alerting the operator prior to needle reciprocation to facilitate accurate placement a recurring series of tailor tacks in work fabrics to facilitate accurate placement of isolated tailor tacks, the present invention combines the above with the feature of reversion to the initial stitch of the recurring pattern upon each selection of the pattern and combination with a single pattern facility which further prevents inadvertent needle reciprocation.

4 Claims, 5 Drawing Figures

Fig. 1.
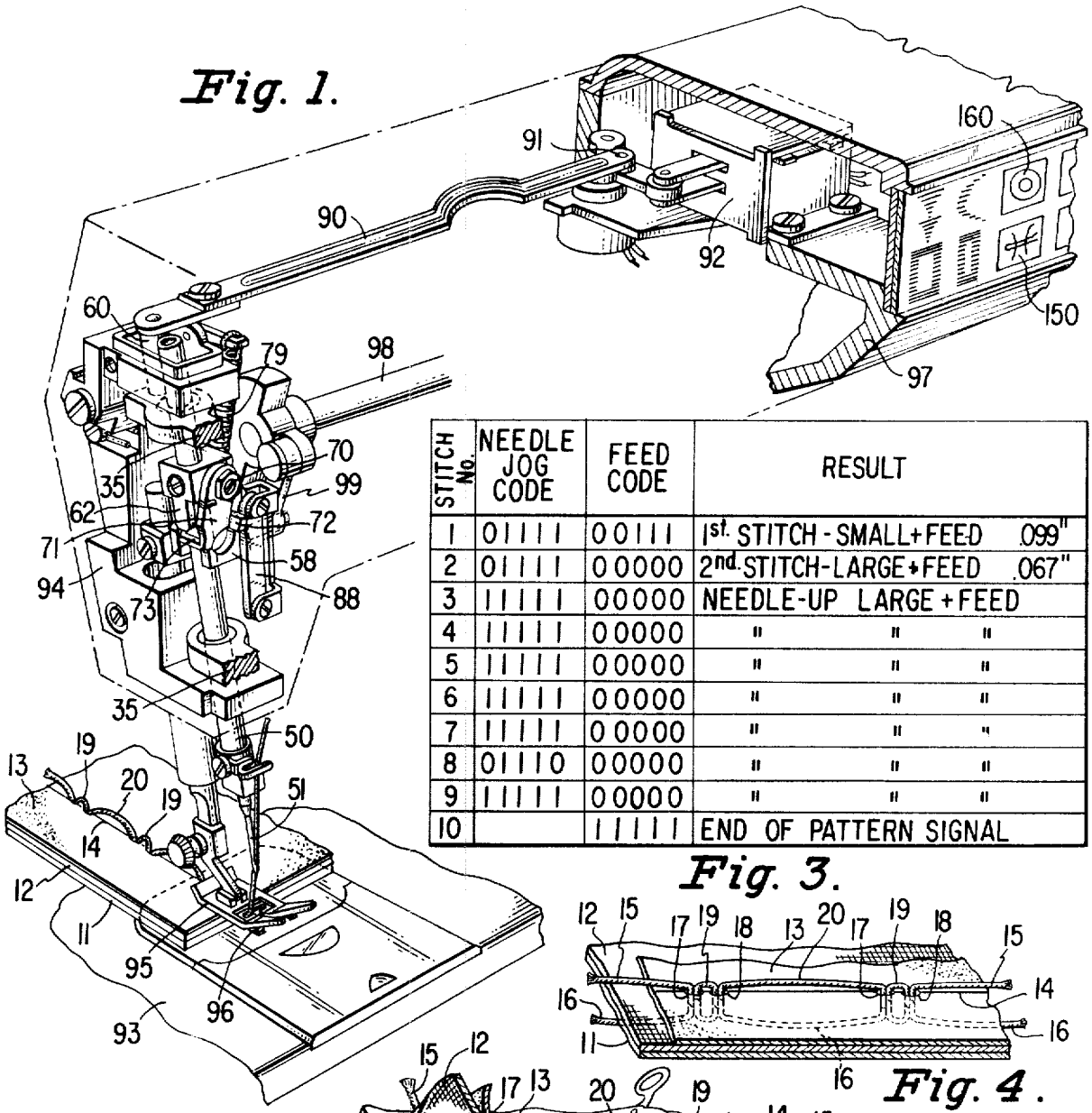
| STITCH No. | NEEDLE JOG CODE | FEED CODE | RESULT |
|---|---|---|---|
| 1 | 01111 | 00111 | 1st. STITCH - SMALL+FEED .099" |
| 2 | 01111 | 00000 | 2nd. STITCH-LARGE+FEED .067" |
| 3 | 11111 | 00000 | NEEDLE-UP LARGE + FEED |
| 4 | 11111 | 00000 | " " " |
| 5 | 11111 | 00000 | " " " |
| 6 | 11111 | 00000 | " " " |
| 7 | 11111 | 00000 | " " " |
| 8 | 01110 | 00000 | " " " |
| 9 | 11111 | 00000 | " " " |
| 10 | | 11111 | END OF PATTERN SIGNAL |
Fig. 3.
Fig. 4.
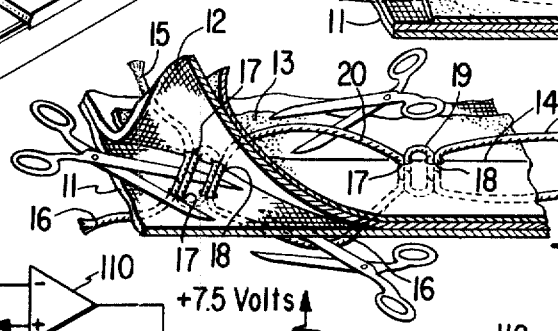
Fig. 5.
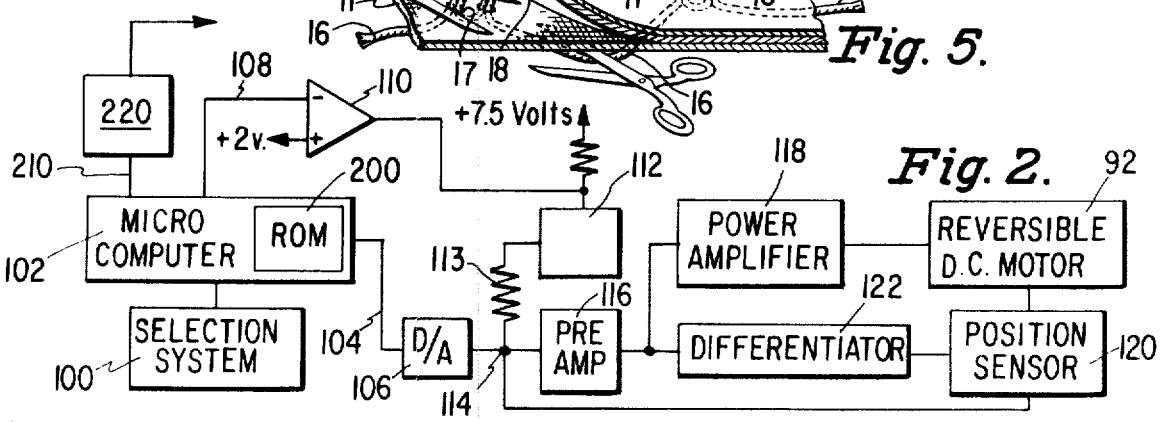
Fig. 2.

PATTERN CONTROLLED SEWING MACHINE FOR PRODUCING TAILOR TACKS

BACKGROUND OF THE INVENTION

1. Field of the Invention

This invention relates to the field of sewing machine stitch formation, and more particularly, to an arrangement for facilitating the placement of threads through superimposed plies of work fabric by the operation of a sewing machine to provide tailor tacks.

2. Description of the Prior Art

A tailor tack is a length of thread which is passed transversely through superposed plies of work fabric in such a small number of closely spaced stitches as will allow controlled lengthwise reeving of the thread when the work fabric plies are separated so that when severed between the separated plies portions of the thread will remain extending transversely through each of the work fabric plies to mark common or matching locations on the plies.

It is known to apply tailor tacks using a threaded hand sewing needle which is understandably a tedious, time consuming operation. Equally tediuous and time consuming is a known technique for using a sewing machine to produce the tailor tack stitches in which known technique each needle reciprocation of the sewing machine is manually controlled, the presser foot is lifted between tailor tacks and the work must be manually advanced through the sewing machine between desired locations for tailor tacks.

One other technique is known for utilizing a zig zag sewing machine to produce tailor tacks in which a presser device with a raised stitch supporting finger is employed. By zig zagging over the stitch supporting finger, loose stitches are formed so that the plies may be separated and the stitches severed therebetween to provide the marking threads in each of the plies. The disadvantage of this known technique stems from the relatively small amount of looseness or surplus thread which the stitch supporting finger can provide because of the necessity for the needle to pass with clearance over the finger. As a result, so small a length of surplus tailor tacking thread is provided that the threads are frequently withdrawn completely from one or both of the plies during ply separation and severance of the threads therebetween. Another disadvantage of this known technique is the limitation of thickness of the work fabrics with which it may be used without elevating the stitch supporting finger high enough to interfere with the traverse of the needle and the safety hazard occasioned by the resulting possibility of needle breakage.

SUMMARY OF THE INVENTION

It is an object of this invention to provide an arrangement in a sewing machine for placing tailor tack threads through superposed plies of work fabrics in a recurring series and with surplus thread therebetween comparable to that provided using the hand sewing needle technique to mark a prospective seam line or the like as the completely automatic operation of the sewing machine without the necessity for special attachments and requiring only the guiding of the superposed plies of work fabric to the influence of the conventional sewing machine work feeding mechanism.

Another object of this invention is the provision of means, compatable with the above stated object, whereby at the option of the operator the sewing machine may be manipulated conveniently to place tailor tacks at any specific predetermined locations on the work fabrics.

As a result of this invention, tailor tacks with generous amounts of surplus thread may be accurately applied much more quickly and easily than heretofore.

DESCRIPTION OF THE DRAWINGS

In the accompanying drawings:

FIG. 1 is a perspective view of portions of a sewing machine having this invention applied thereto;

FIG. 2 is an electronic block diagram indicating the implementation of this invention;

FIG. 3 is a logic code table indicating stitch pattern and control data in the ROM portion of the microcomputer for influencing a stitch pattern implementing this invention;

FIG. 4 is a perspective view of a portion of superposed work fabrics surmounted by a garment pattern and having a stitched seam applied thereto in accordance with this invention for the production of tailor tacks; and FIG. 5 is a perspective view of the work fabric plies of FIG. 4 separated slightly to reeve the threads of the stitch seam through the plies and indicating the locations for severing the threads of the seam to produce a finished tailor tack.

DESCRIPTION OF THE INVENTION

Referring to FIGS. 4 and 5, a tailor tack of the type which can be produced with this invention will be described. FIGS. 4 and 5 illustrate a superposed arrangement of two plies of work fabric, an under ply 11 and a top ply 12, with a garment pattern element 13 made of tissue paper or the like surmounting the top ply 12. A tailor tack is used to indicate a location on both fabric plies which is common or matching as indicated, for instance, by printed instructions on the pattern element. The line 14 shown on the pattern element 13 of FIGS. 1, 4, and 5 indicates a seam line which is to be marked on both fabric plies 11 and 12 alike by tailor tacks. To mark the location of the seam line 14 on both fabric panels 11 and 12, threads 15 and 16 are concatenated into a recurring pattern of two penetrations 17 and 18 of the work fabric by the thread separated by a very small space or stitch 19 and followed by a comparatively long space or stitch 20 between the second penetration 18 of one pair of work penetrations and the first penetration 17 of the next succeeding pair of penetrations.

FIG. 5 illustrates the assembly of plies and thread of FIG. 4 but with the superposed fabric plies 11 and 12 separated showing that by separation of the plies 11 and 12 the threads 15 and 16 will reeve through the penetrations 17 and 18. The representations of scissors in FIG. 5 indicates where the threads 15 and 16 must be severed in order to provide separate lengths of thread protruding transversely through each of the fabric plies to serve as location markers. Where recurring tailor tacks are placed in a series, as for instance, along a prospective seam line using this invention, it may be found more convenient not to sever the under or bobbin thread 16 between groups of needle penetrations but only to sever the threads between the separated plies and the long lengths of the top or needle thread 15.

In addition to the provision of recurring tailor tacks as, for instance, to mark a prospective seam line or the like, occasions arise in which isolated tailor tacks are required as, for instance, to denote dart locations, button locations and the like. As will be described hereinbelow, this invention includes features advantageously suited for the placement of isolated tailor tacking threads.

FIG. 1 illustrates the salient parts of a sewing machine which includes features in accordance with this invention for facilitating the production of tailor tacks either in recurring array along prescribed lines or isolated at predetermined specific locations. The sewing machine illustrated in FIG. 1 and the block diagram illustrated in FIG. 2 include features forming the subject matter of copending U.S. patent application Ser. No. 239,834, filed Mar. 21, 1981 which is incorporated herein by reference. This referenced patent application relates to an arrangement in a sewing machine for decoupling and maintaining a sewing needle inoperative during continued operation of other mechanisms of a sewing machine. That much of a description of the parts illustrated in FIGS. 1 and 2 relating to the referenced patent application will be set forth hereinbelow as to provide an understanding of the use of this arrangement in the production of tailor tacks.

Fragments of a conventional sewing machine frame illustrated in FIG. 1 include a work supporting bed 93, a sewing head 94 overhanging the bed and adapted to sustain mechanism for reciprocating a needle bar 50 and a needle 51 secured thereto and for supporting a presser device 95 which opposes the feed dog 96 of a work advancing feed mechanism in the bed. The machine frame also includes a bracket arm 97 in which is journalled an arm shaft 98 with a crank mechanism 99 for imparting endwise reciprocatory movement to the needle by way of a crank with a bifurcated drive stud 58. The needle bar 50 is slidable endwise in a gate 35 pivotally mounted in the sewing head 94 and adapted to be swung laterally by a driving link 90 which embraces a driving post 60 on the gate 35 and is pivoted as at 91 to the output linkage of a linear motor 92 carried in the bracket arm.

The needle bar 50 is not connected directly to the bifurcated portion 58 of the drive stud, but instead carries a collar 62 to which a latch lever 71 is pivoted at 70. An ear 72 on the latch lever 71 engages latch release abutment 88 when the gate 35 is sewing abnormally to the right as viewed in FIG. 1 causing a latch surface 73 on the latch lever 71 to disengage from the bifurcated portion 58 of the drive stud thus releasing the needle bar from the drive stud. Conventionally such release of the needle bar is used to provide basting stitches. A spring 79 connected to the collar 62 and the sewing head 94 then causes the needle to be elevated to a position in which it can be reconnected to the drive stud only near the top of a subsequent drive stud stroke.

In order to provide the capability for utilizing the linear motor 92 to effectuate separation of the needle bar from the driving stud, the circuitry of FIG. 2 is provided. In FIG. 2 a selection system 100 is provided from which selection may be made of ornamental patterns, or stitch functions such as tailor tacking, single pattern, or the like. Selection of an ornamental pattern will cause actuation of the needle bar release mechanism for the first stitch in order to prevent the placement of an erroneous stitch, as is taught in U.S. Pat. No. 3,847,100 issued on Nov. 12, 1974. A needle bar release is also initiated at the completion of an ornamental pattern if the single pattern functional selection has also been made. Selection of a pattern or function is analyzed by a microcomputer 102 and proper instructions are passed along line 104 to a digital-to-analog converter 106. In the event that a needle bar release is required, the microcomputer 102 will pass along a center needle position signal to the digital-to-analog converter 106 along line 104, and a second signal will pass along line 108 to a level shifter 110. The output of the level shifter 110 is applied to the gate of a solid state switch 112 which will close to apply a regulated voltage to a summing point 114 at the input to a servo amplifier system composed of a preamp 116, power amplifier 118 and reversible linear motor 92, which reversible motor 92 carries a position sensor 120 for feedback to a differentiator 122 and to the summing point 114.

The center needle position signal is fed to the digital-to-analog converter 106 so as to have the converter provide a zero input to the summing point 114 input to the servo-amplifier for regulating needle position. Another signal, other than that representing center needle position, may be supplied to the digital-to-analog converter 106, it only being necessary to provide for the same signal for each needle bar release and make suitable adjustments to the regulated voltage applied to the solid state switch 112, or to the resistance 113 so that the reversible linear motor 92 will unerringly effect separation of the needle bar 50 from the bifurcated portion 58 of the driving stud.

As shown in FIG. 2, the microcomputer 102 preferably includes a ROM 200 which may be permanently programmed with stitch pattern data for influencing many different stitch patterns as well as or in addition to data for influencing control functions to be executed by the microcomputer.

Indicated at 150 in FIG. 1 is an operator influenced selector switch forming a part of the selection system 100 and effective when actuated to render effective a stitch pattern stored in the ROM 200 appropriate for forming tailor tacks. FIG. 3 is a chart indicating the needle jog (bight) and work feed codes commensurate with the electronic stitch pattern means described in the U.S. patent of J. W. Wurst U.S. Pat. No. 3,872,800, Mar. 25, 1975 for a pattern of 10 stitches adapted to produce recurring stitches in a pattern as illustrated in FIG. 4. For this pattern of stitches the needle jog code 01111 shown for stitches one and two of the tailor tack designate the center needle position but it will be understood that as explained above, any other lateral position within the possible lateral range of needle positions would suffice. For the feed the work advance on the first stitch (effective between the first and second needle penetrations) is influenced by a code 00111 chosen to produce a relatively small stitch length preferably on the order of one tenth of an inch, whereas on the subsequent 9 stitches of the pattern, the code 00000 is preferably chosen so as to produce a large stitch, preferably the largest possible stitch such as, 0.167 inches per stitch or a total of approximately 1½ inch. After the first two stitches, the ROM is programmed to include in place of the needle jogging code, a control code such as 11111 which may, preferrably, include code information not utilized for influencing needle jogging but recognizable by the microcomputer for effecting special operations. The code 11111 illustrated in FIG. 3 in the needle jog column for stitches 3 to 9, is code information recognizable by the microcomputer 102 as control information dictating release of the needle bar as discussed above and explained in detail in U.S. Pat. No. 3,847,100. In addition, the code information 01110 for stitches 8 may include code information recognizable by the microcomputer 102 as dictating, in addition to release of the needle bar, a further operation such as initiation of a signal on line 210 from the microcomputer for operating visible or audible warning means 220 to alert the sewing machine operator of an impending needle reciprocation. Such a signal is advantageous in that in following a prospective seam line 14, the operator need not follow the line as precisely during operation cycles 3 to 9 but can give special attention to accurate guiding of the work when the signal indicates impending needle reciprocation. As shown in FIG. 3, on stitch 10 of the tailor tack pattern a special end of pattern code word 11111 is provided in the feed code column resulting in return to the first stitch of the pattern. Thus, from the second needle penetration of the tailor tack to and including the last stitch forming cycle of the pattern, the needle 51 will be maintained released and elevated by the spring 79.

It is to be understood that the specific number of stitches, work feed lengths, etc. which are described above and illustrated in FIG. 3, are chosen by way of preferred embodment and these may be varied to suit any special needs or preferrences.

For producing a recurring series of tailor tacks, for instance, to mark a seam line or the like, the sewing machine operator need only select the tailor tack pattern by closing selector switch 150, place the superposed work plies and pattern element beneath the presser device of the sewing machine and operate the sewing machine to advance the work along the denoted seam line 14 and the threads forming the tailor tacks will automatically be inserted, adequate surplus of thread will be provided between pairs of needle penetrations, and the work will be advanced evenly and smoothly by the sewing machine work feed mechanism without the danger of disruption of the registry of the superposed plies which might occur if manual shift of the work is attempted.

In the event that an isolated tailor tack is required as for instance, to mark the beginning of a dart, a button location, or the like, the need arises for means to dictate the occurrance of the two closely spaced needle penetrations at a specific location on work fabrics. This is provided conveniently by actuation of the selector switch 150 when the desired location for the isolated tailor tack is positioned beneath the needle aperture in the presser device. Wherever the sewing machine may have been within the 10 stitches of the tailor tack pattern, it is a feature of the electronic stitch pattern control of the referenced J. W. Wurst U.S. Pat. No. 3,872,808 and incorporated in the construction of this invention, that slection or reselection of any pattern always reverts the control back to the first stitch of the selected pattern. Prior to this invention, the utility of reversion to the first stitch of a selected pattern resided in the reliance by the operator on the appearance of the pattern which would be stitched. A novel advantage of reversion to the first stitch of the pattern upon each selection of the tailor tack pattern is that it provides for accurate placement on work fabrics of the needle penetrations of the tailor tack pattern.

In the event that the need arises for a series of isolated tailor tacks to be provided, an advantageous combination of use of the tailor tack selector switch and a selector switch 160 for single patterning is available with this invention. As described in detail in the U.S. Pat. No. 3,987,739, Oct. 26, 1976 which is incorporated herein by reference, actuation of the single pattern switch 160 effects, upon receipt of an end of pattern signal, release of the needle bar coupling and thus suspension of needle bar reciprocation until a reselection of a stitch pattern is made. By closing both selector switches 150 and 160, the sewing machine will produce one tailor tack and then even if operation of the sewing machine is continued a repeat of the tailor tack pattern is impossible until the tailor tack switch 150 is again closed. As a result, all danger of inadvertent placement of a tailor tack in an undesired location by continued sewing machine operation will be avoided.

I claim:

1. A tailor tack producing arrangement in a sewing machine having an endwise reciprocatory thread carrying needle, a work feeding mechanism, needle reciprocation interrupting means effective during operation of said work feeding mechanism, and a static electronic memory for storing stitch pattern information for controlling said work feeding mechanism and said needle reciprocation interrupting means, said tailor tack producing arrangement comprising stitch pattern information stored in said electronic memory for influencing the formation of a recurring stitch pattern comprising two successive endwise needle reciprocations with one intervening work advance by said work feeding mechanism followed by operation of said needle reciprocation interrupting means during a predetermined multiplicity of successive work advance increments by said work feeding mechanism, and operator influenced means on said sewing machine for selecting said recurring stitch pattern information in said electronic memory to produce widely spaced groups of two closely spaced stitches along any desired prospective line of stitches and severable for delineating said prospective line of stitches by tailor tacks.

2. A tailor tack producing arrangement as set forth in claim 1 in which warning means are provided on said sewing machine, and in which control information is stored in said static electric memory effective to initiate operation of said warning means on a preselected one of said work advance increments by said work feeding mechanism during needle reciprocation interruption to alert a sewing machine operator of impending needle reciprocation.

3. A tailor tack producing arrangement in a sewing machine having an endwise reciprocatory thread carrying needle, a work feeding mechanism, needle reciprocation interrupting means effective during operation of said work feeding mechanism, and a static electronic memory for storing stitch pattern information for controlling said work feeding mechanism and said needle reciprocation interrupting means, said tailor tack producing arrangement comprising stitch pattern information stored in said electronic memory for influencing the formation of a recurring stitch pattern comprising two successive endwise needle reciprocations with one intervening work advance by said work feeding mechanism followed by operation of said needle reciprocation interrupting means during a predetermined multiplicity of successive work advance increments by said work feeding mechanism, operator influenced means on said sewing machine for selecting said recurring stitch pattern information in said electronic memory, and means effective on the sewing machine stitch forming cycle next following each operation of said selecting means for effecting the first of said two successive endwise needle reciprocations of said stitch pattern stored in said electronic memory to produce said two closely spaced stitches at any desired specific location on the work and severable for delineation of said specific location on the work by a tailor tack.

4. A tailor tack producing arrangement in a sewing machine having an endwise reciprocatory thread carrying needle, a work feeding mechanism, needle reciprocation interrupting means effective during operation of said work feeding mechanism, and a static electronic memory for storing stitch pattern information for controlling said work feeding mechanism and said needle reciprocation interrupting means, said tailor tack producing arrangement comprising stitch pattern information stored in said electronic memory for influencing the formation of a recurring stitch pattern comprising two successive endwise needle reciprocations with one intervening work advance by said work feeding mechanism followed by operation of said needle reciprocation interrupting means during a predetermined multiplicity of successive work advanve increments by said work feeding mechanism, operator influenced means on said sewing machine for selecting said recurring stitch pattern information in said electronic memory, means effective on the sewing machine stitch forming cycle next following each operation of said selecting means for effecting the first of said two successive endwise needle reciprocations of said stitch pattern stored in said electronic memory, a single pattern control on said sewing machine, effective upon completion of any selected stitch pattern to render said needle reciprocation and work feeding mechanisms inoperative preventing formation of additional stitches until reselection of said recurring stitch pattern thus to provide for accurate isolated placement of only two closely spaced stitches.

* * * * *